United States Patent [19]

Auhorn et al.

[11] Patent Number: 4,908,240

[45] Date of Patent: Mar. 13, 1990

[54] PRINTABILITY OF PAPER

[75] Inventors: Werner Auhorn, Frankenthal; Hans-Juergen Degen, Lorsch; Lothar Hoehr, Worms; Ulrich Riebeling, Schifferstadt, all of Fed. Rep. of Germany

[73] Assignee: BASF Aktiengesellschaft, Ludwigshafen, Fed. Rep. of Germany

[21] Appl. No.: 244,679

[22] Filed: Sep. 15, 1988

[30] Foreign Application Priority Data

Sep. 15, 1987 [DE] Fed. Rep. of Germany ..... 3730887

[51] Int. Cl.[4] ..... B05D 3/02

[52] U.S. Cl. ..... 427/391; 428/512; 428/513; 428/514; 524/427; 524/447; 524/788; 524/789; 524/819

[58] Field of Search ..... 427/391; 428/512, 513, 428/514; 524/427, 447, 788, 789, 819

[56] References Cited

U.S. PATENT DOCUMENTS

| | | | |
|---|---|---|---|
| 4,278,583 | 7/1981 | Sekiya | 428/511 X |
| 4,304,703 | 12/1981 | Das | 525/260 X |
| 4,554,181 | 11/1985 | Cousin et al. | 427/261 |
| 4,775,420 | 10/1988 | Gonnet et al. | 524/447 X |

FOREIGN PATENT DOCUMENTS 2835125 2/1979 Fed. Rep. of Germany .

*Primary Examiner*—Michael Lusignan

*Attorney, Agent, or Firm*—Oblon, Spivak, McClelland, Maier & Neustadt

[57] ABSTRACT

The printability of paper is improved by applying an aqueous coating agent consisting of (a) 100 parts by weight of a finely divided pigment, (b) from 5 to 70 parts by weight, based on solids, of a cationic aqueous polymer dispersion of a paper size and (c) from 0.01 to 10 parts by weight of a surfactant which interferes with the formation of the surface size and/or of a polymeric dispersant in an amount of from 0.5 to 4 g/m$^2$ to one or both surfaces of the paper and drying the coated paper.

10 Claims, No Drawings

PRINTABILITY OF PAPER

In order to improve the properties of raw papers, the surface of the paper is either sized or provided with a pigment coating. For example, European Patent No. 51,144 discloses that polymer dispersions containing finely divided, nitrogen-containing monomers as copolymerized units can be used as engine sizes and surface sizes for paper and for coating or impregnating paper and building materials. However, these coating agents do not contain pigments. The polymer dispersions are prepared by a two-stage polymerization in which, in a first polymerization stage, a low molecular weight prepolymer is prepared from a monomer mixture which contains a nitrogen-containing monomer, e.g. dimethylaminoethyl acrylate, one or more nonionic, hydrophobic, ethylenically unsaturated monomers, these monomers forming hydrophobic polymers when polymerized alone, and an ethylenically unsaturated carboxylic acid or maleic anhydride, in a water-miscible solvent by a solution copolymerization method, the solution of the prepolymer is then diluted with water and, in the second polymerization stage, from 1 to 32 parts by weight, based on 1 part by weight of solution copolymer, of one or more nonionic, hydrophobic, ethylenically unsaturated monomers are polymerized in this polymer solution by an emulsion polymerization method in the presence of conventional amounts of water-soluble polymerization initiators. As the examples show, these polymer dispersions are good surface sizes.

German Laid-Open Application DOS 2,835,125 discloses a paper coating material which contains from 1 to 30 parts by weight, based on the solids content, of an amphoteric copolymer latex per 100 parts by weight of a pigment. The copolymer contain$ from 20 to 50% by weight of an aliphatic conjugated diolefin, from 0.5 to 5% by weight of an ethylenically unsaturated acidic monomer, e.g. acrylic acid, methacrylic acid or itaconic acid, from 0.5 to 5% by weight of an ethylenically unsaturated amine monomer, e.g. diethylamincethyl methacrylate, and from 10 to 74% by weight of a monoolefinically unsaturated monomer, e.g. styrene. The latex must not contain more than 1% by weight, based on the copolymer, of an emulsifier and should have a gelling point within the pH range from 3.5 to 8.5 and be capable of gelling during drying of the paper coated with the coating material. According to Example 1, the amount of the coating material applied to one side of the paper is about 16 g/m$^2$. The printability of the papers improved with the aid of the pigment coating. This process has from the outset the disadvantage that, owing to the large amount of coating material applied, it is impossible to produce papers having particularly low basis weights. The disadvantages in the case of surface sizing are the limited production capacity resulting from the fact that the surface sizes are applied by means of the size press.

It is an object of the present invention to provide a process for improving the printability of paper, in which high machine speeds can be used, allowing treatment of the paper to be coupled directly with the papermaking process.

We have found that this object is achieved, according to the invention, by a process for improving the printability of paper by applying an aqueous coating agent consisting of pigments and binders to one or both surfaces of the paper and drying the coated paper, if a mixture of (a) 100 parts by weight of a finely divided pigment,
(b) from 5 to 70 parts by weight, based on polymer, of a cationic aqueous polymer dispersion of a paper size, whose polymer has a glass transition temperature of 5° to 80° C., and
(c) from 0.01 to 10 parts by weight of a surfactant which interferes with the formation of the surface size, and/or of a polymeric dispersant is used as the coating agent in an amount of from 0.5 to 4 g/m$^2$. Up to 90, preferably from 5 to 30,% by weight of the polymer of component (b) can be replaced by a water-soluble polysaccharide. Although the component (b) is a typical cationic surface size for paper, the sizing action of the size in the formulation applied is virtually completely eliminated and, surprisingly, the printability of the paper thus treated is substantially improved. Particularly noteworthy are the properties such as opacity, strike-through, translucence, whiteness and brightness, which are improved by the novel process.

The novel process can be used generally to improve the printability of any raw paper which is uncoated and has not been subjected to any other conversion. These are uncoated and unbleached papers, preferably wood-containing printing paper which is generally supercalendered and has a basis weight of not less than 30, preferably more than 35, g/m$^2$. The uncoated and unbleached paper used should have uniform ink receptivity and should be very smooth. Papers of this type are used mainly for newspapers, illustrated periodicals and advertising brochures. The stated paper grades are printed, for example, by the offset or gravure printing methods.

The coating agent to be used according to the invention is a mixture of the abovementioned components (a) to (c). Finely divided pigments are used as component (a) of the mixture. These are the pigments conventionally used in paper coating, for example calcium carbonate, chalk, kaolin, clay, titanium dixoide, barium sulfate, satin white, talc, aluminum silicate, calcium sulfate or magnesium carbonate. The particle size of the pigments is from 0.2 to 10 μm. A preferably used pigment is calcium carbonate in which 87% of the particles are smaller than 2 μm.

Components (b) used are cationic aqueous polymer dispersions of a paper size whose polymer has a glass transition temperature of from 5° to 80° C. Cationic polymer dispersions of this type are known and, when applied alone to the surface of the paper, size the paper. The cationic nature of the dispersion arises from the fact that one or more cationic monomers are incorporated as copolymerized units in the polymer of the dispersion, or one or more cationic emulsifiers are used where exclusively nonionic monomers are used in the polymerization. It is of course also possible to use both cationic monomers and cationic emulsifiers in the polymerization. In the mixture with the other two components of the coating agent, these dispersions act as binders and, together with the other components, help to improve the printability of the paper. Suitable cationic dispersions b) contain, for example, from 1 to 40% by weight of one or more cationic monomers as copolymerized units. Dispersions of this type are disclosed in, for example, German Patent No. 1,696,326 and German Published Application DAS 1,546,236. These cationic dispersions are prepared by emulsion polymerization in the presence of cationic and/or nonionic emulsifiers. Suitable cationic compounds are, for example, of the general formula

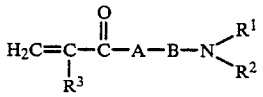

(I)

where

A is O or NH,

B is $C_mH_{2n}$, n is from 1 to 8, $R^1$ and $R^2$ are each $C_mH_{2m+1}$, m is from 1 to 4 and $R^3$ is H or $CH_3$.

The quaternized compounds can be defined by the formula

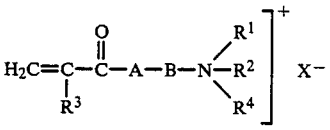

(II)

where $X^-$ is $OH^-$, $Cl^-$, $Br^-$ or $CH_3OSO_3—H^-$ and $R^4$ is $C_mH_2m+1$ and m is from 1 to 4. The other substituents have the meanings stated in formula I.

Basic, ethylenically unsaturated monomers are, for example, acrylates and methacrylates of amino alcohols, e.g. dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, dibutylaminopropyl acrylate, dibutylaminopropyl methacrylate or dimethylaminoneopentyl acrylate, and amino-containing derivatives of acrylamide or of methacrylamide, such as acrylamidodimethylpropylamine, methacrylamidodimethylpropylamine and methacrylamidodiethylpropylamine.

The quaternary compounds of the formula II are obtained by reacting the basic monomers of the formula I with known quaternizing agents, for example with benzyl chloride, methyl chloride, ethyl chloride, butyl bromide, dimethyl sulfate and diethyl sulfate. These monomers lose their basic character in the quaternized form. The compounds of the formula I can also be used in the copolymerization in the form of the salts with inorganic or saturated organic acids.

Other suitable basic monomers are, for example, N-vinylimidazole, 2-methylvinylimidazole, N-vinylimidazoline, 2-methylvinylimidazoline and the corresponding quaternization products or salts of the stated basic monomers.

Suitable cationic paper sizes are disclosed, for example, in the following publications: German Laid-Open Applications DOS 2,452,585, DOS 3,401,573 and DOS 2,519,581, European Patents 51,144 and 58,313, German Published Application DAS 1,621,689, EP-A-221,400 and EP-A-165,150.

The cationic sizes stated in the abovementioned specifications are dispersions which are prepared by a two-stage polymerization process, cationically modified polyurethane dispersions and copolymers which are obtainable by direct copolymerization of the monomers. In the two-stage polymerization, a low molecular weight polymer is first prepared and is then used as an emulsifier for the subsequent emulsion polymerization. The low molecular weight polymer which is first prepared and used as a cationic emulsifier can contain, for example, from 5 to 100% by weight of a basic nitrogen-containing monomer as copolymerized units and can have a solution viscosity $\eta_{rel}$ of from 1.05 to 1.4. The viscosity $\eta_{rel}$ is measured in water at a pH of 3.5 and at 25° C., at a polymer concentration of 1 g/100 ml of water. This low molecular weight polymer then serves as the emulsifier for the emulsion polymerization of monomer mixtures, which for example have the following composition:

(1) from 20 to 65% by weight of acrylonitrile, methacrylonitrile, methyl methacrylate and/or styrene, (2) from 35 to 80% by weight of one or more acrylates or methacrylates of monohydric saturated $C_3$–$C_8$-alcohols, vinyl acetate, vinyl propionate and/or 1,3-butadiene, and (3) from 0 to 10% by weight of other ethylenically unsaturated copolymerizable monomers, the sum of the percentages by weight under (1) to (3) always being 100. The cationic character of the polymer dispersions in this case is based on the content of the low molecular weight cationic polymer prepared in the first stage of the polymerization.

Polymer dispersions which are particularly preferably used as component b) are those which are obtainable by copolymerization of from 10 to 56 parts by weight of a monomer mixture of (1) from 20 to 65% by weight of acrylonitrile, methacrylonitrile, methyl methacrylate and/or styrene, (2) from 35 to 80% by weight of one or more acrylates or methacrylates of monohydric saturated $C_3$–$C_8$-alcohols, vinyl acetate, vinyl propionate and/or 1,3-butadiene and (3) from 0 to 10% by weight of other ethylenically unsaturated copolymerizable monomers, the sum of the percentages by weight under (1) to (3) always being 100, by an emulsion polymerization method in 100 parts by weight of an aqueous solution which contains, in solution, from 1.5 to 25% by weight of a cationic starch having a viscosity $n_i$ of from 0.04 to 0.50 dl/g, at from 40° to 100° C. in the presence of an initiator possessing peroxide groups. The monomers of group (1) are preferably used in an amount of from 25 to 62% by weight. From this group of monomers, styrene and acrylonitrile are preferably used.

The monomers of group (2) include acrylates and methacrylates which are derived from monohydric saturated $C_3$–$C_8$-alcohols, e.g. n-propyl acrylate, isopropyl acrylate, n-butyl acrylate, isobutyl acrylate, tert-butyl acrylate, neopentyl acrylate, n-hexyl acrylate, cyclohexyl acrylate or 2-ethylhexyl acrylate, and the corresponding methacrylates, e.g. n-propyl methacrylate, isopropyl methacrylate, isobutyl methacrylate and 2-ethylhexyl methacrylate. The monomers of group (2) are preferably used in amounts of from 38 to 75% by weight.

Examples of suitable monomers of group (3), which may be used to modify the copolymers, are ethylenically unsaturated $C_3$–$C_5$-carboxylic acids, such as acrylic acid, methacrylic acid, maleic acid, fumaric acid, or itaconic acid, and maleic half esters. This group of monomers includes vinylsulfonic acid and 2-acrylamidomethylpropanesulfonic acid and water-soluble salts of the stated carboxylic acids and sulfonic acids. The ethylenically unsaturated carboxylic acids and sulfonic acids can be completely or partially, for example from 5 to 95%, neutralized with sodium hydroxide solution, potassium hydroxide solution, ammonia and/or amines.

The copolymers of the monomers of groups (1) and (2) can also be modified by incorporating basic compounds as monomers of group (3) in the form of copolymerized units, the said compounds having been mentioned above (cf. formulae I and II), and in addition N-vinylimidazole and N-vinylimidazoline and the corresponding quaternized and substituted compounds.

The monomers of groups (1) to (3) are copolymerized by emulsion copolymerization in an aqueous medium in the presence of digested cationic starches having a viscosity $\eta_i$ of from 0.04 to 0.50 dl/g. Such starches contain quaternized aminoalkyl groups. These starches are available commercially. If the viscosity of these starches is not already in the stated range, they are subjected to oxidative, thermal, acidolytic or enzymatic digestion until the desired viscosity is obtained. Cationic, enzymatically digested potato starch is preferably used. The degree of substitution of the cationic starch is from 0.01 to 0.1 mole of nitrogen per mole of glucose units.

The viscosity $\eta_i$ (also referred to as intrinsic viscosity) of the starch is calculated from the relative viscosity $\eta_{rel}$ according to the following equation $$\eta_i = (2.303 \times \log n_{rel})/\text{concentration}.$$

The concentration is stated in g/100 ml. The relative viscosity of the digested starch solutions is determined on 1% strength by weight aqueous solutions using a capillary viscometer at 25° C. and a pH of 3.5, the relative viscosity being calculated from the corrected flow times of the solvent $t_0$ and solution $t_1$, in accordance with the following equation $$n_{rel} = t_i/t_0.$$

Conversion to $\eta_i$ is effected using the abovementioned relationship, on the basis of the information in Methods in Carbohydrate Chemistry, Volume IV, Starch, Academic Press, New York and London, 1964, page 127.

To prepare the finely divided copolymer dispersions, an aqueous solution which contains, in solution, from 1.5 to 25, preferably from 1.7 to 21, % by weight of a digested starch having a viscosity $n_i$ of from 0.04 to 0.50 dl/g is first produced. Digested starches having a viscosity of from 0.3 to 0.5 dl/g are preferably used when it is intended to prepare dispersions having a low solids content. The digested starches having a lower viscosity, i.e. from 0.04 to about 0.3 dl/g, are preferably used in the preparation of dispersions having higher solids contents, e.g. from 25 to 40% by weight. It is also possible to use mixtures of starches having different viscosities $\eta_i$ as protective colloids, but the viscosity of the mixture must be in the stated $n_i$ range of from 0.04 to 0.50 dl/g, i.e. it is possible in this case also to use starch mixtures in which the viscosity of one type of starch is outside the stated range. From 10 to 56 parts by weight of a monomer mixture of the components (1) to (3) are subjected to copolymerization per 100 parts by weight of such an aqueous starch solution. The monomers can be emulsified in the aqueous solution of the digested starch either in the form of a mixture or separately from one another. In order to stabilize the emulsion, a small amount of an emulsifier can be added to the aqueous starch solution. However, it is also possible first to emulsify the monomers in water using an emulsifier and then to add them in the form of the emulsion to the aqueous starch solution. Suitable emulsifiers for this purpose are anionic or cationic products. Examples of such emulsifiers are sodium alkylsulfonate, sodium laurylsulfate, sodium dodecylbenzenesulfonate and dimethylalkylbenzylammonium chloride. It is advisable to use anionic emulsifiers in the case of anionic starches and cationic emulsifiers for cationic starches. The amount of emulsifier which may be present is from 0 to 0.3, preferably from 0.05 to 0.2, % by weight, based on the sum of the monomers (1) to (3) used. However, the emulsion polymerization is preferably carried out in the absence of an emulsifier.

The copolymerization of the monomer in the aqueous solution of the digested starch is carried out at from 40° to 110° C., preferably from 50° to 100° C., in the presence of an initiator containing peroxide groups. Suitable polymerization initiators are primarily hydrogen peroxide, combinations of hydrogen peroxide with a heavy metal salt, e.g. iron(II) sulfate, or a redox system consisting of hydrogen peroxide with a suitable reducing agent, such as sodium formaldehyde sulfoxylate, ascorbic acid, sodium disulfite and/or sodium dithionite. A redox system consisting of hydrogen peroxide, a reducing agent or a mixture of the stated reducing agents and in addition a small amount of a heavy metal salt, for example iron(II) sulfate, is preferably used. Other suitable initiators containing peroxide groups are, for example, organic peroxides, hydroperoxides and peroxydisulfate. Examples of suitable compounds of this type are tertbutyl hydroperoxide, acetylcyclohexylsulfonyl peroxide, sodium peroxididisulfate, potassium peroxidisulfate and ammonium peroxidisulfate.

Thorough mixing of the components must be ensured during the polymerization. For example, the reaction mixture is preferably stirred during the entire duration of the polymerization and any subsequent polymerization, in order to reduce the residual monomer content. The polymerization is carried out in the absence of oxygen, in an inert gas atmosphere, e.g. under nitrogen. In order to initiate polymerization, the oxygen is first removed from the aqueous solution of the starch and from the monomers, and from 1 to 40% of the monomers to be polymerized are first added to the aqueous solution of the starch and are emulsified therein by stirring the reaction mixture. As a result of prior, simultaneous or subsequent addition of an aqueous initiator solution, the polymerization begins, as a rule after a short induction period. The heat of polymerization evolved at the beginning of the polymerization can be used to heat the reaction mixture. The temperature may increase to 90° C. As soon as the initially taken monomers have been polymerized, the remainder of the monomers and the initiator solution are added continuously or a little at a time and polymerization is carried out with stirring. The copolymerization can, however, also be carried out batchwise or continuously. A finely divided, aqueous dispersion is obtained in which the copolymer particles are surrounded by a protective colloid shell based on digested starch. A measure of the fineness of the dispersion is the LT value (light transmittance of the dispersion). The LT value is determined by measuring the transmittance of the dispersion in 0.01% strength by weight aqueous solution in a cell having an edge length of 2.5 cm using light of the wavelength 546 nm and comparing the transmittance with the transmittance of water under the abovementioned conditions. The transmittance of water is stated as 100%. The more finely divided the dispersion, the higher is the LT value measured by the method described above.

The mean particle size of the copolymer particles without the protective colloid shell of digested starch can be determined if the starch shell of the latex particles is subjected to virtually complete enzymatic digestion. Possible coagulation of the copolymer dispersion can be prevented by adding a suitable emulsifier. After the enzymatic digestion, the particle size of the copolymer dispersion can be measured using a commercial apparatus, for example the Nanosizer from Coulter Electronics. The mean diameter of the copolymer particles without the protective colloid shell is from 75 to 110 nm.

The aqueous polymer dispersions of component (b) are prepared in every case with a composition such that the polymers have a glass transition temperature of from 5° to 80° C., preferably from 15° to 60° C. The concentration of the polymer in the aqueous dispersion is from 15 to 55, preferably from 20 to 45, % by weight. The coating agents contain from 5 to 70, preferably from 8 to 30, parts by weight, based on the solids content of the dispersion, of component b) per 100 parts by weight of a finely divided pigment or of a mixture of pigments. Preferably, from 5 to 30% by weight of the polymer of component (b) or of a mixture of polymers of component (b) are replaced by one or more water-soluble polysaccharides. Suitable water-soluble polysaccharides are water-soluble starches, carboxymethylcellulose, methylcellulose, hydroxyethylcellulose and galactomannanes.

Suitable components (c) of the coating agents are surfactants and/or polymeric dispersants, each of which interferes with or prevents surface sizing by the surface size (b). The surfactants and the polymeric dispersants improve the wetability of the paper with water. Suitable surfactant compounds have an HLB value of not less than 10 (for the definition of the HLB value, see W. C. Griffin, J. Cosmetic Chemist, 5 (1954) 311). The suitable surfactants are listed, for example, as surfactant classes in Tensid-Taschenbuch by Dr. Stachel, Carl-Hanser-Verlag, Munich-Vienna, 2nd edition 1981, pages 4–10. Nonionic, anionic or cationic surfactants can be used. Products of this type are obtained, for example, by an addition reaction of ethylene oxide and/or propylene oxide with phenols, amines, fatty acids and alcohols of 8 to 22 carbon atoms. Of particular interest from this group of compounds are, for example, the adducts of from 10 to 50 moles of ethylene oxide with 1 mole of dodecanol, $C_9/C_{13}$ alcohols and nonylphenol. Among the anionic surfactants, sodium laurylsulfonate is particularly suitable as component (c).

Examples of suitable polymeric dispersants of component (c) are polymers of ethylenically unsaturated $C_3$–$C_5$-carboxylic acids having a K value of from 10 to 50 (measured in 1% strength aqueous solution at 25° C. and pH 8 on the sodium salt of the polymers), polymers of acrylamide, methacrylamide and vinylpyrrolidone, having a K value of from 10 to 60, polyvinyl alcohols having a molecular weight of from 2,000 to 200,000, ligninsulfonates, phenyl/formaldehyde condensates, urea/formaldehyde condensates, melamine/formaldehyde condensates, sulfonated, aromatic formaldehyde condensates, polyamidoamines, commercial polyethyleneimines and polydiallyldimethylammonium chlorides having a molecular weight of from 2,000 to 200,000.

Homopolymers of acrylic acid or of methacrylic acid, having a K value of from 10 to 40 (measured in 1% strength by weight aqueous solution at 25° C. and pH 8 on the Na salt of the polymers) are preferably used as polymeric dispersants of component c). A process for the preparation of such polymers is disclosed in, for example, U.S. Pat. No. 4,301,266. In addition to the stated homopolymers, it is also possible to use copolymers of acrylic acid and/or methacrylic acid with acrylamidomethylpropanesulfonic acids in the preferred embodiment of the novel process. Copolymers of this type are disclosed in, for example, U.S. Pat. No. 4,450,013, as dispersants and milling assistants for pigments. Preferably used copolymers contain from 5 to 60% by weight of acrylamidomethylpropanesulfonic acid as copolymerized units and have a K valve of from 12 to 35 (measured on the Na salt in 1% strength aqueous solution at pH 8). It is of course also possible to use copolymers of acrylic acid and methacrylic acid which contain the monomers copolymerized in any ratio and have a K value of from 10 to 50, or homopolymers of acrylamido-2-methylpropanesulfonic acid, having a K value of from 10 to 35, as polymeric dispersants of component c).

The coating agents to be used according to the invention are obtained by mixing the individual components (a) to (c). For example, the pigments can be introduced into the aqueous cationic polymer dispersion of a paper size and one or more of the suitable compounds (c) can then be added, or an aqueous pigment suspension whose solids concentration is, for example, from 40 to 85% by weight can first be prepared by mixing the components (a) and (c) and the resulting aqueous pigment suspension can then be mixed with one or more cationic aqueous polymer dispersions of a paper size. A particularly preferred procedure is one which employs aqueous suspensions of pigments, which are obtainable by milling and dispersing the pigments in the presence of polymers of ethylenically unsaturated $C_5$–$C_5$-carboxylic acids, having a K value of from 10 to 50 (measured in 1% strength aqueous solution at 25° C. and pH 8 on the Na salt of the polymer). In these cases, the pigment used is preferably calcium carbonate or chalk, and the polymeric dispersant employed is preferably polyacrylic acid or a copolymer of acrylic acid and acrylamidomethylpropanesulfonic acid, having a K value of from 10 to 30 (measured on the Na salt as stated above). This procedure gives particularly finely divided pigment suspensions in which about 90% of the dispersed particles have a size of $<2$ μm. Even at high concentrations, for example at solids contents of from 60 to 80% by weight, pigment suspensions of this type have a viscosity such that the suspensions are easy to handle. These pigment suspensions are then mixed with one or more cationic aqueous polymer dispersions according to (b). The coating agents, which are then applied to the surface of the paper, have a solids content of from 5 to 60, preferably from 15 to 35%, % by weight. The pH of the coating agent is from 5 to 10.

The coating agents are applied to one or both sides of the paper, preferably continuously with the aid of a known apparatus as used in the paper coating process, for example a blade, a speed sizer or a short-dwell coater. The paper web is fed through the coating unit at a speed of more than 750, preferably from 1,000 to 1,400, m/min. These high speeds during the coating process make it possible to couple paper coating directly with papermaking and to integrate a coating unit in a paper machine. In this case, an uncoated and unbleached paper which can be used, for example, in offset printing and gravure printing and as newsprint is obtained directly.

At the high working speeds, from 0.5 to 4, preferably from 1 to 2.5 g/m$^2$ of coating agent are applied. Because the amount of coating agent applied is substantially smaller compared with the conventional process for coating paper, it is also possible to make relatively light-weight papers which have good printability.

In the examples which follow, parts and percentages are by weight. The K values were determined according to H. Fikentscher, Cellulose Chemie, 13 (1932), 48–64 and 71–74, in aqueous solution at a pH of 8, at 25° C. and at a polymeric concentration of 1% of the sodium salt of the copolymer; K =k.10$^3$. The relative viscosity was measured on a 1% strength by weight aqueous solution at 25° C. and a pH of 3.5 using a capillary viscometer. The intrinsic viscosity was calculated from the relative viscosity using the abovementioned formula.

The printability of the coated papers was evaluated on the basis of the whiteness, brightness, opacity, strike-through and translucence. To determine the whiteness, the reflectance factor was measured according to DIN 53,145. The opacity was determined according to DIN 53,146. The other criteria were determined by the methods below:

Brightness measurement

Apparatus: Elrepho meter

Filter: FMY/C

For this measurement, unprinted sheets (with the same side facing upward) are placed one on top of the other on a black velvet surface in an amount such that the value to be read no longer changes when further sheets are added (infinity measurement). Depending on the size of the paper sheets, from 3 to 5 individual measurements are sufficient to give a representative mean value. The results are stated as reflectances in percent, based on the white standard according to DIN 53,145. The brightness measurement is based on the same principle as the whiteness measurement (DIN 53,145).

Strike-through

Apparatus for printing: Haindl gravure printing apparatus

Apparatus for the measurement: Elrepho meter

Filter for the measurement: FMY/C

X=Brightness covered

Y=Brightness full-shade back

Z=Brightness in the stack

Measurement X:

A printed sheet is covered with a unprinted sheet from the same test series in such a way that the two identical sides rest against one another (for example unprinted wire side on printed wire side). The measurement was carried out over the large, rectangular full-shade area without a black velvet underlay. Usually, the mean of 3 individual measurements per sheet is stated, the mean values being expressed as reflectances in percent, based on the white standard according to DIN 53,145.

Measurement Y:

A printed sheet is measured from the rear over the large rectangular full-shade area, likewise without a black velvet underlay. The mean of 3 individual measurements is likewise stated. In this measurement too, the values are expressed as reflectances in percent, based on the white standard according to DIN 53,145.

Calculation for the strike-through: $\frac{X-Y}{Z} \cdot 100$

Translucence

The measurements and apparatuses are described above under strike-through.

Calculation for the translucence:

$$\left(\frac{Z-Y}{Z} \cdot 100\right) - \left(\frac{X-Y}{Z} \cdot 100\right)$$

The degree of sizing of the papers was determined by means of the Cobb value (60 sec) according to DIN 53,132 and the ink flotation time to 50% strike-through with a standard ink according to DIN 53,126. Preparation of the cationic polymer dispersions Cationic dispersion 1

A 40% strength cationic polymer dispersion which has an LT value of 84 is prepared by copolymerization of 20 parts by weight of an N-vinylimidazole quaternized with dimethyl sulfate, 26 parts of acrylonitrile and 54 parts of n-butyl acrylate, as described in German Patent 1,696,326.

Cationic dispersion 2

20.7 parts of an 82% strength aqueous cationic potato starch ($\eta_i$=0.1 dl/g, degree of substitution 0.025 mole of nitrogen per mole of glucose units) are dissolved in 133 parts by weight of water at 85° C. in a polymerization vessel equipped with stirrer, metering apparatuses and an apparatus for working under nitrogen. 3.7 parts of glacial acetic acid and 0.03 part of iron sulfate ($FeSO_4.7H_2O$) are added and 0.8 part of 30% strength hydrogen peroxide is then introduced, followed, after 20 minutes, by 0.8 g of 30% strength hydrogen peroxide. An emulsion of 44 parts of n-butyl acrylate and 39 parts of styrene in a solution of 0.045 part of sodium laurylsulfate in 29 parts of water are then metered in in the course of 2 hours and, beginning at the same time, 14 parts of a 5.5% strength hydrogen peroxide solution are metered in from a second vessel. After the addition of the monomers and of the hydrogen peroxide has ended, the reaction mixture is polymerized for a further hour at 85° C. A cationic dispersion having a solids content of 34% and an LT value of 86 is obtained.

Cationic dispersion 3

148 g of water and 34.0 g of the starch I described below and 8.4 g of the starch II likewise defined below are initially taken in a 1-L four-necked flask equipped with a stirrer, a reflux condenser, metering apparatuses and an apparatus for working under a nitrogen atmosphere, and the stirred mixture is heated to 85° C. The starch I is a digested, cationic potato starch having an intrinsic viscosity $\eta_i$ of 0.47 dl/g, a degree of substitution of 0.027 mole of nitrogen per mole of glucose units and 0.015 mole of COOH groups per mole of glucose units. The solids content of the starch is 83%. Starch II is a digested, cationic potato starch having an intrinsic viscosity $\eta_i$ of 1.16 dl/g and a degree of substitution of 0.07 mole of nitrogen per mole of glucose units. The solids content of the starch is 83%.

2.6 g of an aqueous 10% strength calcium acetate solution and 10 g of a 1% strength enzyme solution (α-amylase A) are added after the mixture has been stirred for 30 minutes at 85° C. After a further 20 minutes at 85° C., the enzymatic digestion of starch is terminated by adding 7.5 g of glacial acetic acid. Thereafter, 16.5 g of a 1% strength iron(II) sulfate solution and 1.75 g of 30% strength hydrogen peroxide are added. After 20 minutes, the hydrogen peroxide has decomposed and the oxidative digestion of starch is complete. The intrinsic viscosity of the starch mixture is then 0.08 dl/g. 1.8 g of 30% strength hydrogen peroxide are then added and, starting immediately, an emulsion which consists of 93.7 g of acrylonitrile, 76.4 g of n-butyl acrylate and a solution of 0.2 g of sodium $C_{14}$-alkylsulfonate in 50 g of water is added uniformly in the course of one hour and, simultaneously but separately, 50 g of a 3.12% strength hydrogen peroxide solution are added in the course of 1.75 hours. During this time and for 60 minutes after the end of the metering of the monomers and hydrogen peroxide, the temperature of the reaction mixture is kept at 85° C. A cationic dispersion having a solids content of 40.5% and an LT value of 82 (particle diameter without starch shell 143 nm) results.

Comparative dispersion 1

An anionic copolymer dispersion is prepared by an emulsion polymerization method at 80° C. by metering an emulsion of 66.3 parts of n-butyl acrylate, 14 parts of acrylonitrile, 15 parts of styrene and 4 parts of acrylic acid and, simultaneously with this, an aqueous solution of potassium peroxidisulfate into an aqueous solution of sodium laurylsulfonate and carrying out polymerization therein. A 50% strength anionic polymer dispersion having an LT value of 72 is obtained.

Comparative dispersion 2

In accordance with Japanese Preliminary Published Application 58/115196, 500 parts of a 6.6% strength aqueous solution of an oxidatively digested potato starch are initially taken in a 2-l flask provided with a stirrer and a reflux condenser. The digested potato starch has an intrinsic viscosity $n_i$ of 0.27 dl/g and a degree of substitution of 0.034 mole of carboxyl groups per mole of glucose units. 44 parts of styrene, 71.7 parts of n-butyl acrylate and 21.7 parts of tert-butyl acrylate and 3 parts of potassium peroxidisulfate in 50 parts of water are then added to the initially taken solution, which has been heated to 80°–90° C. An anionic polymer dispersion having a solids content of 25% and an LT value of 90 is obtained.

General method for the preparation of the coating agents

In a kettle provided with a stirrer, 100 kg of the pigment shown in the table are dispersed in 150 kg of water with the addition of, in each case, 0.5 kg of the sodium salt of a homopolymer of acrylic acid, having a K value of 20. An aqueous starch solution which is obtained by dissolving 6.7 kg of a cationic or oxidatively digested starch in 70 kg of water is prepared separately from this. The cationic starch has an intrinsic viscosity $n_i$ of 1.6 and a degree of substitution of 0.09 mole of nitrogen per mole of glucose unit. The oxidatively digested starch has an intrinsic viscosity $\eta_i$ of 0.6 dl/g and a degree of substitution of 0.025 mole of COOH groups per mole of glucose units.

The coating agents are then prepared by adding 3.3 kg, based on polymer, of each of the cationic dispersions 1 to 3 and of each of the comparative dispersions 1 and 2 to the mixture of pigment suspension and soluble starch described above. By adding 150 kg of water in each case, the coating agent is brought to a solids content of about 25% by weight.

The coating agents described above are each used to coat both sides of an uncoated and unbleached gravure printing paper having a basis weight of 60 g/m² in a pilot coating unit by means of a blade applicator at a web speed of 1,000 m/min. The weight applied is 1 g per m² per side. After application of the coating agent, the coated web is dried. The table shows the coating agents used and the properties of the coated papers obtained in each case. It can be seen from the table that a considerable improvement in the printability in comparison with the comparative dispersions is achieved according to the invention.

TABLE

| | Composition of the coating agent in parts by weight (based in each case on solids content) | | | | | | |
|---|---|---|---|---|---|---|---|
| | Example 1 | Example 2 | Comparative Example 1 | Comparative Example 2 | Comparative Example 3 | Example 3 | Example 4 |
| Calcium carbonate | 100 | — | — | 100 | 100 | 100 | 100 |
| China clay | — | 100 | — | — | — | — | — |
| Na salt of polyacrylic acid, K value 20 | 0.5 | 0.5 | — | 0.5 | 0.5 | 0.5 | 0.5 |
| Digested cationic starch | 6.7 | 6.7 | 6.7 | 6.7 | — | — | — |
| Oxidatively digested starch | — | — | — | — | 6.7 | 6.7 | 6.7 |
| Cationic dispersion 1 | — | — | — | — | — | 33.3 | — |
| Cationic dispersion 2 | 33.3 | 33.3 | — | — | — | — | — |
| Cationic dispersion 3 | — | — | — | — | — | — | 33.3 |
| Comparative dispersion 1 | — | — | — | — | 33.3 | — | — |
| Comparative dispersion 2 | — | — | 33.3 | 33.3 | — | — | — |
| | Evaluation of the printability of the coated unbleached gravure printing paper | | | | | | |
| Whiteness %, R 457 | 70.1 | 69.09 | 64 | 67.1 | 67.0 | 69.9 | 70.1 |
| Brightness % | 74.8 | 74.4 | 70.3 | 73.1 | 73.2 | 74.1 | 74.3 |
| Opacity % | 94.9 | 95.3 | 90.9 | 93.1 | 92.1 | 93.4 | 93.5 |
| Strike-through | 2.1 | 2.4 | 5.6 | 3.9 | 4.1 | 2.7 | 2.9 |
| Translucence | 5.1 | 5.0 | 8.7 | 6.5 | 6.5 | 5.3 | 5.1 |
| Sizing | 0 | 0 | 40 | 0 | 0 | 0 | 0 |
| ink flotation time (50% strike-through) | 55 | 53 | 23 | 50 | 45 | 60 | 57 |
| Cobb (60 sec.) | | | | | | | |

We claim:

1. A process for improving the printability of paper, wherein an aqueous coating agent consisting of (a) 100 parts by weight of a finely divided pigment, (b) from 5 to 70 parts by weight, based on polymer, of a cationic aqueous polymer dispersion of a paper size whose polymer has a glass transition temperature of from 5° to 80° C. and (c) from 0.01 to 10 parts by weight of a surfactant which interferes with the formation of the surface size and/or of a polymeric dispersant is applied in an amount of from 0.5 to 4 g/m$^2$ to one or both surfaces of the paper and the coated paper is dried.

2. A process as claimed in claim 1, wherein up to 90% by weight of the polymer of component (b) is replaced with a water-soluble polysaccharide.

3. A process as claimed in claim 1, wherein from 5 to 30% by weight of the polymer of component (b) is replaced with a water-soluble polysaccharide.

4. A process as claimed in claim 1, wherein a coating agent is used which is obtainable by mixing components (a) and (c) in the form of aqueous pigment suspensions with component (b).

5. A process as claimed in claim 1, wherein components (a) and (c) are used in the form of aqueous suspensions of pigments, which are obtainable by milling and dispersing the pigments in the presence of a polymer of an ethylenically unsaturated $C_3$–$C_5$-carboxylic acid having a K value of from 10 to 50 (measured in 1% strength by weight aqueous solution at 25° C. and pH 8 on the Na salt of the polymer) as a polymeric dispersant of component (c).

6. A process as claimed in claim 1, wherein a cationic polymer dispersion which contains from 1 to 40% by weight of one or more cationic monomers as copolymerized units is used as component (b).

7. A process as claimed in claim 1, wherein a polymer dispersion is used which is obtainable by polymerizing the monomers in the presence of from 0.2 to 40% by weight, based on the monomers, of a cationic emulsifier.

8. A process as claimed in claim 7, wherein cationic starch is used as the cationic emulsifier.

9. A process as claimed in claim 7, wherein the cationic emulsifier used is a polymer which contains, as copolymerized units, from 5 to 100% by weight of a monomer possessing basic nitrogen atoms and has a solution viscosity $\eta_{rel}$ of from 1.05 to 1.4 (measured in 1% strength by weight aqueous solution at 25° C. and pH 3.5).

10. A process as claimed in claim 7, wherein the component (b) used is a polymer dispersion which is obtainable by copolymerization of from 10 to 56 parts by weight of a monomer mixture of (1) from 20 to 65% by weight of acrylonitrile, methacrylonitrile and/or styrene, (2) from 35 to 80% by weight of one or more acrylates or methacrylates of monohydric, saturated $C_3$–$C_8$-alcohols, vinyl acetate, vinyl propionate and/or 1,3-butadiene and (3) from 0 to 10% by weight of other ethylenically unsaturated copolymerizable monomers, by an emulsion polymerization method in 100 parts by weight of an aqueous solution which contains in solution from1.5 to 25% by weight of a cationic starch having a viscosity $\eta_i$ of from 0.04 to 0.50 dl/g, at from 40 to 100° C. in the presence of an initiator possessing peroxide groups.

* * * * *